United States Patent [19]

Egerer

[11] 4,394,789

[45] Jul. 26, 1983

[54] TOOTHED EDGING MEANS FOR TEXTILE MACHINERY

[75] Inventor: Josef Egerer, Schwabach, Fed. Rep. of Germany

[73] Assignee: Staedtler & Uhl, Schwabach, Fed. Rep. of Germany

[21] Appl. No.: 236,398

[22] Filed: Feb. 20, 1981

[30] Foreign Application Priority Data

Feb. 27, 1980 [DE] Fed. Rep. of Germany ..... 3007245

[51] Int. Cl.[3] ..... D01G 15/84

[52] U.S. Cl. ..... 19/97; 19/114; 19/234

[58] Field of Search ..... 19/113, 114, 112, 97, 19/83, 233, 234

[56] References Cited

U.S. PATENT DOCUMENTS 542,605 7/1895 Clay et al. ..... 19/97

1,811,549 6/1931 Langer ..... 19/114

3,419,941 1/1969 Moriwaki ..... 19/234

FOREIGN PATENT DOCUMENTS 5884 of 1890 United Kingdom ..... 19/113

*Primary Examiner*—Louis Rimrodt

*Attorney, Agent, or Firm*—Jordan and Hamburg

[57] ABSTRACT

Toothed edging apparatus for mounting on a rotatable support of a textile machine includes tooth segments each having a plurality of teeth elements arranged generally along an arc and a foot portion from which the teeth elements extend, the foot portion being mounted on the rotatable support of the textile machine. At least one recess is provided in the segments, and a holding element passes through the recesses and is secured to the support for holding a plurality of such segments on the rotatable support, the holding element having a longitudinal axis disposed generally parallel to the axis of the rotatable support.

8 Claims, 13 Drawing Figures

TOOTHED EDGING MEANS FOR TEXTILE MACHINERY

BACKGROUND OF THE INVENTION

This invention relates to toothed edging for rollers and carrying segments of textile machines, such as combing machines, drawing and processing rollers for open-end-devices and similar machines as they are used for combing or processing fibers such as wool, cotton or synthetic fibers.

Such devices are usually provided in various fashions with toothed card wire which is wound in helically fashion upon a cylindrical basic body. In a first known arrangement, the windings immediately abut each other so that the breadth of the foot of the card wire determines the axial distance of the neighboring teeth from each other. The card wire is usually glued to the base body. In order to gain a segment, the cylindrical base body, prepared in this manner, is divided in an axial direction together with the card wire. It is also known to press the saw tooth wire into a groove which is formed in the circumferential plane of the roller in a helical manner. In another known arrangement, the saw tooth wire is directly wound upon the cylindrical surface area of a processing cylinder in a helical line and wherein neighboring windings abut or are arranged at distances from each other. In such an arrangement the saw tooth wire may also be, like in the groove fastening, held to the roller by glue. Frequently, the beginning and the end of the saw tooth wire are clamped into a recessed part of the groove.

Known arrangements of this kind begin with tooth rows of a helical shape. Thus consecutive teeth do not follow each other in radial planes as would be desirable considering the desired effect of the process. In any case this helical shape diminshes considerably the freedom of construction.

The fact that the saw tooth material is delivered as a wire prevents hardening of the teeth along their whole height because hardening could cause breaking of the wire. It is obvious that such a method leads to shortened life of the saw tooth material.

This known arrangement results furthermore in the problem that even limited damage to the saw tooth material of a carrier segment or a roller, respectively requires renewal or replacement of the whole saw tooth element. Refitting must be done in shops especially equipped for this purpose because special tools are needed for replacing with a new saw tooth wire material. This again requires an excessively large storage of replacement parts besides the increased costs.

An object of the present invention is to overcome these and other disadvantages of known prior art devices and to provide a saw tooth arrangement for carrier segments and rollers of textile machines of the above-mentioned kind which has improved properties of use, increased life expectancy, and lower costs. According to the present invention, the tooth elements consist of tooth segments, outwardly circularly shaped and having an internal abutting surface towards the roller or carrier segment, respectively as well as at least one axially extending recess for accepting a support element which is disposed parallel to the axis and which passes through the side-by-side arranged tooth segments to connect these segments and which is fastened to the roller or segment.

According to this arrangement, the tooth edging consists of a plurality of individual elements, which are connected to each other and which are fastened to the carrier segment or roller by means of the same connecting means. It is particularly advantageous to manufacture the tooth segments out of sheet metal stampings. The structure of the tooth surface according to the invention has also the advantage that individual tooth segments may be hardened all the way through, because they are not deformed during trimming as was the saw tooth wire in known prior art arrangements. This increases the life expectancy considerably and stoppages of machinery is prevented which was heretofore required to effect replacement of the tooth wires. Such an improvement is of great value as regards cost saving in the production process. In case of damage to any part of the toothed edging, individual parts are easily exchanged for new ones.

It is within the framework of the present invention that the tooth segments extend over a maximum angle of 180°. They are easily set from outside upon the carrier segment or the roller and fastened thereupon. According to one embodiment, the tooth segments may be formed annularly and slid upon a roller body in an axial direction. According to the circumstances, one or the other embodiment may be 90° or 60° or any other sizes which may find practical use. For various uses, the radial inside bearing surface of the tooth segments may be formed in the shape of a circular arc. This is used with an analogously shaped acceptance surface on the rollers or carrier segments. It is of course also possible to flatten these abutting planes. The manufacture of the tooth segments as punched parts is extremely simple, so that they may be adapted without any difficulties to the individual shape of the abutting surface of the roller or carrier segment.

Each individual tooth segment may be received or fitted into the grooves when parallel grooves are formed in the abutting surface of the roller or carrier segment. In such a case, there is no fixing needed like for instance a clamping of the foot of the segment. In contradistinction to known prior art arrangements, the mounting in the grooves according to the present invention is needed only in order to determine the planes of the individual tooth segments and their distances from each other. Fastening of the individual tooth elements is effected by one or several holding elements. This has the advantage that the grooves will not be damaged.

The grooves formed in the abutting surface of the roller or the carrier segment may be arranged helically. Also the grooves may be arranged side-by-side in circular or radial planes of the roller of the carrier segment. This construction is only possible when using tooth segments according to the invention, because the use of a known prior art saw tooth wire requires that it be wound on the roller in one piece, thereby requiring a helical groove.

The tooth segments may be arranged abuttingly on a roller or carrier segment which is not provided with grooves. In such a case, the width of the tooth foot determines the axial distance of the teeth from each other. An alternative arrangement of the invention provides for at least one spacer between each tooth segment, and the radial height of the spacer corresponds to the height of the foot of the tooth segment. In this arrangement, the axial distance of one foot from the other one is determined by the breadth of the foot and the thickness of the spacer. This arrangement allows a great number of variations as regards the distances of the tooth rows from each other.

According to one embodiment, it is particularly advantageous to use a pin or rod as a holding or anchoring element and to anchor it in opposite cheeks or flange of the roller or carrier segment. The recess accepting the pin or rod into the tooth segments has a cross section corresponding to the cross section of the pin or rod. Instead of a pin or rod connection, it is possible, according to the invention, that the holder rod consists of a dovetail profile fastened along the generatrix of the roller or carrier segment or a similar part, and the tooth segments are pushed in an axial direction upon the dovetailed part. In such a case, the tooth segments are provided with a recess analogous to the dovetailed part, the recess beginning at the foot of the tooth segments. In a given case, the roller or carrier segment may be provided with a stationary cheek or flange and a cheek or flange to be fastened after the fastening of the tooth segments.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

DESCRIPTION OF THE PREFERRED EMBODIMENTS

Figure 1:
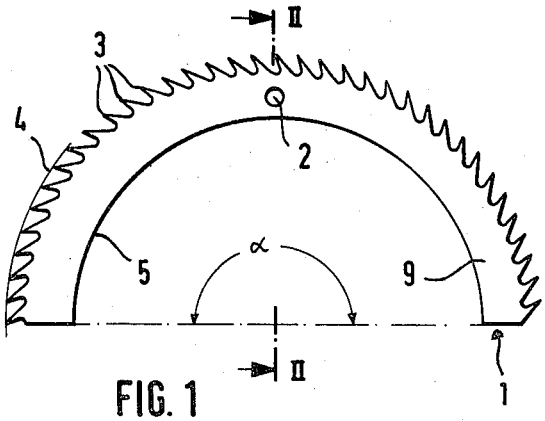
FIG. 1 is a front elevational view of a tooth segment extending over an angle of 180° according to one embodiment of the present invention.
Figure 2:
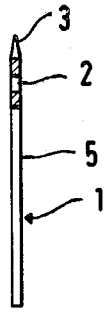
FIG. 2 is a sectional view taken along the line II—II in FIG. 1.

The toothed surfaces of rollers or carrying segments of textile machinery such as combing machines, drawing machines, and processing rollers for open-ended devices serving for the carrying of rollers or carrying segments of textile machines consists of a plurality of individual tooth segments 1 suitably formed such as by being stamped out of sheet metal, having the desired strength and having undergone a hardening process. In the embodiment of FIG. 1, the tooth segment extends over an angle of 180°. The tooth segment 1 has in its center a circular borehole 2 and also has points of teeth 3 which lie upon a common circular arc 4. An abutting surface 5 disposed radially inside is also shaped like a circular arc about the same center.

Figure 3:
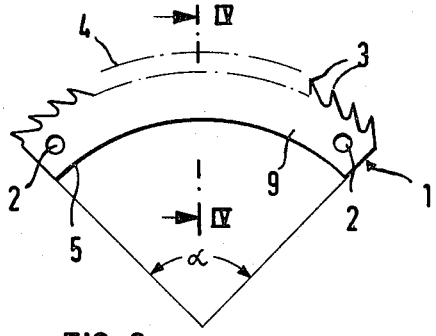
FIG. 3 is an elevational view of a tooth segment of 60° and showing the connection means which is effected by two carrying pins or rods.
Figure 4:
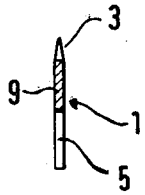
FIG. 4 is a sectional view taken along the line IV—IV in FIG. 3.

The embodiment shown in FIGS. 3 and 4 differs in that it extends over an angle $\alpha$ of only 90° and the segment 1 is furnished with a borehole 2 at both end areas.

Figure 5:
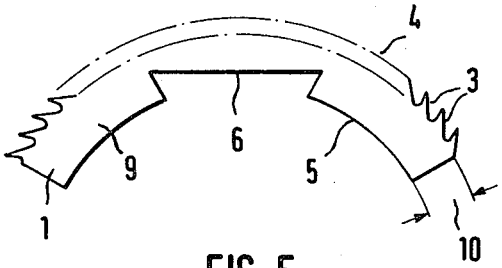
FIGS. 5 and 6 are two different embodiments which include a recess beginning at the inside abutting plane for acceptance of a correspondingly shaped carrying or holding element.
Figure 6:
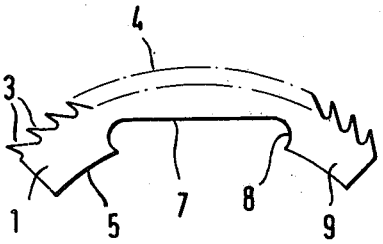
Figure 7:
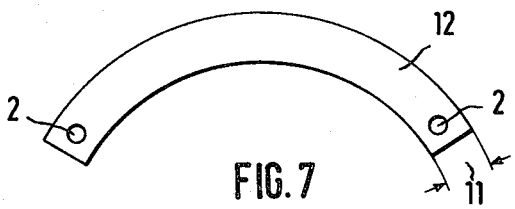
FIG. 7 is an elevational view of a spacer for use with the embodiment of FIG. 5.

The tooth segments 1 in the embodiments of FIGS. 5 and 6 are constructed analogously; however, instead of boreholes 2 as in the prior embodiments, a dovetail shaped recess 6 (FIG. 5) or a recess 7 with circular arc shaped flanks 8 (FIG. 6) are provided. These recesses 6 and 7 begin at the internal abutting plane 5 and extend into the foot 9 of the tooth segment 1. The foot 9 has a radial breadth 10. FIG. 7 shows a spacer 12 and the radial breadth 11 of spacer 12 corresponds to the radial breadth 10 of foot 9. The spacer 12 has two boreholes 2 in its end areas and also recesses corresponding to recesses 6 and 7 of tooth segments 1 of FIGS. 5 and 6.

Figure 8:
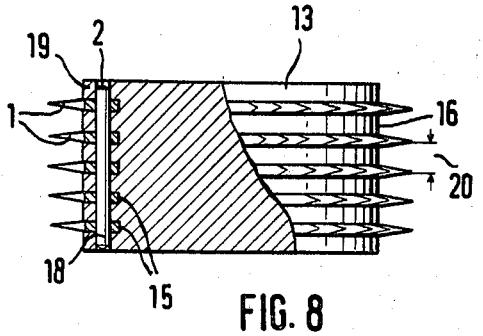
FIG. 8 is a partial sectional view through a roller provided with a toothed outer surface.
Figure 9:
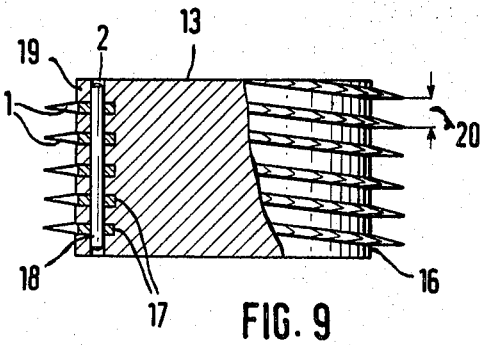
FIG. 9 is a partial sectional view, similar to FIG. 8, but of another embodiment.

Tooth segments 1 are mounted in various ways upon rollers 13 or carrying segments 14. In the embodiment shown in FIG. 8, the roller 13 has a plurality of grooves 15 extending along circular planes, the grooves 15 being formed in the roller 16. Analogous grooves 17 are present in the embodiment of FIG. 9, but they have a helical form. Each groove 15 or 17 receives toothed segments 1 which are arranged in such a manner that their analogously disposed boreholes 2 are aligned and capable of accepting a pin or rod 18. The pin or rod 18 is screwed into the cheeks or flanges 19 of the roller 13 or is fastened by any other method. The distance of grooves 15 or 17 from each other determines the distance or spacing 20 between the tooth rows.

Figure 10:
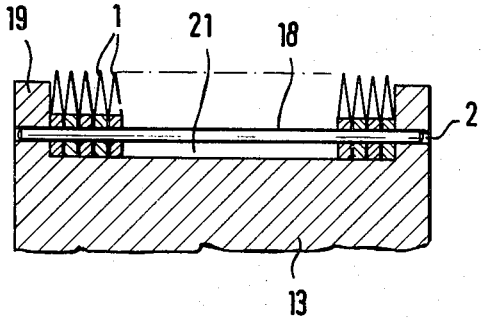
FIG. 10 is a partial sectional view of a roller according to a further embodiment.

The embodiment in FIG. 10 differs by the lack of grooves 15 or 17 and instead, there is provided a wide recess 21 which is terminated at both sides by cheeks 19 in roller 13. Tooth segments 1 are set side-by-side into the recess 21. Also pins or rods 18 either singly or in groups are arranged parallel to the axis and serve as fasteners.

Figure 11:
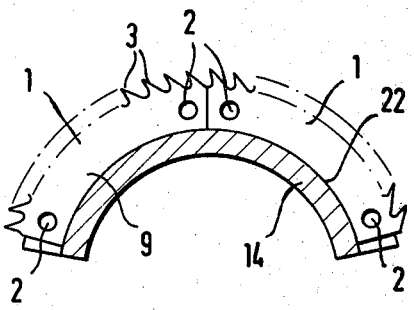
FIG. 11 is a sectional view of a carrying segment provided with a toothed outer surface.
Figure 12:
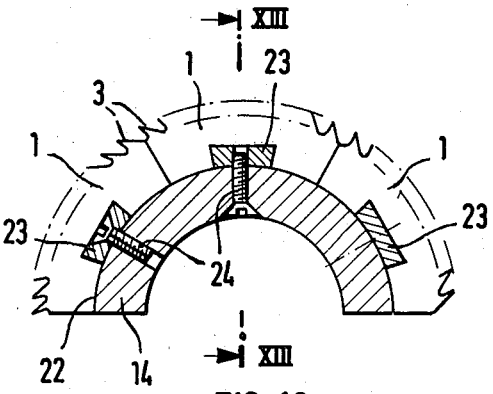
FIG. 12 is a sectional view of a carrying segment with a toothed outer surface, similar to FIG. 11, but of another embodiment.
Figure 13:
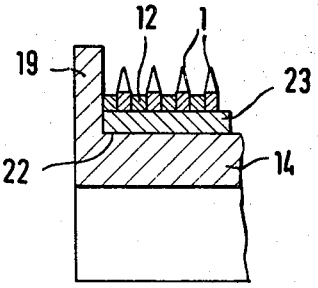
FIG. 13 is a sectional view taken along the line XIII—XIII in FIG. 12.

The carrying segment 14 in the embodiment of FIG. 11 and in the embodiment of FIGS. 12 and 13 is provided with a circular arc-shaped abutting plane 22 upon which the tooth segments 1 are disposed with their foot 9. In FIG. 11, fastening is effected by pins or rods 18 traversing circular recesses 2 and engaged at their ends or sides by the carrying segment 14. The embodiment of FIGS. 12 and 13 differs by utilizing elements 23 which are provided with a dovetail profile running parallel to the axis and disposed upon the circular arc-shaped abutting plane 22. Fastening elements, for example screws 24 serve to fasten the device. The tooth segments 1 which are provided with correspondingly shaped recesses 6 and 7 (FIGS. 5 and 6) are pushed upon these dovetail elements 23, in which case, if so needed, spacers 12

(FIG. 7) are disposed between the individual tooth segments 1.

An additional advantage of the device according to the present invention is that variously toothed segments may be arranged one behind the other in the direction of rotation of the roller or carrying segment, respectively, for instance tooth segments with various tooth shapes or coarse or fine teeth.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. Toothed edging apparatus for mounting on a rotatable support element of a textile machine comprising tooth segments each having a plurality of teeth elements arranged generally along an arc, each of said segments being formed as a stamped sheet metal element, each of said segments having a foot portion from which said teeth elements extend, mounting means mounting said foot portion on said rotatable support element of said textile machine, said mounting means comprising a dovetail male element on said support element of said textile machine and a mating dovetail female groove in said foot portion, said dovetail male element having a longitudinal axis extending parallel to the axis of rotation of said rotatable support element, said tooth segments being insertable on said support element by being slid longitudinally along the axis of said support element as said male and female dovetail elements are engaged, and fastening means detachably fastening said dovetail male element on said support element of said textile machine, said dovetail male element having a radial inner face having a partial cylindrical surface, said support element of said textile machine also having at least a partial cylindrical surface corresponding to the cylindrical surface of said dovetail male element, said fastening means comprising threaded element extending between said dovetail male element and said support element to thereby threadedly connect said dovetail male element to said support element as said cylindrical surface of said dovetail male element engages said corresponding cylindrical surface of said support element.

2. Apparatus according to claim 1 wherein a plurality of said segments are arranged side-by-side on said rotatable support element.

3. Apparatus according to claim 1 wherein said arc does not exceed 180 degrees.

4. Apparatus according to claim 1 wherein said arc is not less than 60 degrees.

5. Apparatus according to claim 1 wherein said segments are disposed on said rotatable support element in axially spaced array.

6. Apparatus according to claim 5 further comprising spacer elements mounted on said rotatable support element and disposed between said segments, said spacer elements having a radial thickness corresponding to the radial thickness of each foot of said segments.

7. Apparatus according to claim 1 wherein said segments are disposed on said rotatable support element to axially abut one another.

8. Toothed edging apparatus according to claim 1 wherein each of said segments is provided with at least a pair of spaced transverse openings, and elongated connecting elements passing through said openings of a plurality of axially aligned segments.

* * * * *